US006193484B1

(12) United States Patent
Hahn et al.

(10) Patent No.: US 6,193,484 B1
(45) Date of Patent: Feb. 27, 2001

(54) FORCE-FIT SCROLL COMPRESSOR ASSEMBLY

(75) Inventors: Gregory W. Hahn, Arkadelphia; Jason J. Hugenroth, Hope, both of AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/176,576

(22) Filed: Oct. 21, 1998

(51) Int. Cl.[7] ..... F01C 1/02
(52) U.S. Cl. ..... 418/55.1; 29/888.022
(58) Field of Search ..... 418/55.1; 29/888.022

(56) References Cited

U.S. PATENT DOCUMENTS

| | | | | |
|---|---|---|---|---|
| 5,131,828 | * | 7/1992 | Richardson, Jr. et al. | 418/55.3 |
| 5,188,520 | | 2/1993 | Nakamura et al. . | |
| 5,247,736 | * | 9/1993 | Fraser, Jr. et al. | 29/888.022 |
| 5,267,844 | * | 12/1993 | Grassbaugh | 417/410 R |
| 5,411,384 | * | 5/1995 | Bass et al. | 418/55.1 |
| 5,547,355 | * | 8/1996 | Watanabe et al. | 418/55.5 |
| 5,674,061 | | 10/1997 | Motegi et al. . | |

FOREIGN PATENT DOCUMENTS

| | | | | |
|---|---|---|---|---|
| 048209A1 | | 4/1991 | (EP) . | |
| 0798465A1 | | 10/1997 | (EP) . | |
| 63309794 | | 12/1988 | (JP) . | |
| 4132890 | | 5/1992 | (JP) . | |
| 5180176 | * | 7/1993 | (JP) | 417/410 R |
| 7324685 | | 12/1995 | (JP) . | |
| 10299681 | | 11/1998 | (JP) . | |

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

A scroll compressor is assembled by force-fitting the pump unit and the lower bearing into the generally cylindrical outer housing. The force-fit holding strength is increased by providing both the crankcase and the bearing support with cylindrical portions. Thus, force-fit holding strength is provided over the entire periphery of the elements. The structure preferably takes the outer housing beyond its plastic yield point, also increasing the hold strength. In this way, the relatively simple method of force-fitting may be utilized to assemble the scroll compressor, while still achieving acceptable holding force.

17 Claims, 3 Drawing Sheets

FORCE-FIT SCROLL COMPRESSOR ASSEMBLY

BACKGROUND OF THE INVENTION

This invention relates to a scroll compressor wherein the housing components are force-fit into the housing cylinder.

Scroll compressors are becoming widely utilized in refrigerant compression applications. In a typical scroll compressor, a pair of scroll members each have a base with a generally spiral wrap extending from the base. One of the two scroll members orbits relative to the other, and the wraps interfit to define compression chambers.

A scroll compressor is typically assembled by preparing a modular "pump unit" which includes the two scroll members and a crank case which supports the orbiting scroll. The pump unit is inserted as a modular preassembled unit into a cylindrical housing. A shaft is then inserted into the pump unit, and supported in a lower bearing.

In the past, pump units have been secured to the cylinders by many different methods. As one example, the pump unit has been welded to the cylinder. Other examples include various bolting arrangements, etc. Similarly, the lower bearing has typically been welded to the cylinder.

These known assemblies have been rather expensive and time consuming. One proposed method has been to force-fit the components into the cylinder. However, the known crankcases and the known lower bearings have been non-continuous at their outer periphery. When these known non-continuous members have been force-fit into the housing, there has thus been force-fit connections at less than the full inner circumference of the housing.

The non-full inner circumference interference fits have caused the shell to take the shape of the inner object, which causes other assembly problems.

Known equations for calculating the holding strength of an interference connection show that a non-continuous member has a much lower holding strength than a generally continuous force-fit member.

In addition, the overall surface contact area between the two members to be held together by an interference fit also effects the holding force. The structure in the prior art compressors which was in contact with the housing have not extended for a long distance, and thus have had relatively small holding areas. Again, this has resulted in undesirably low holding strength.

In the prior art non-continuous force-fit connections, there has not been sufficient holding strength to be practically reliable as the only means of holding the parts. However, these known formulas have never been applied to the concept of interference housing components into scroll compressor cylinders.

In addition, with the prior art, the outer housing did not yield beyond its plastic deformation point. Instead, the housing was able to flow around the spaced contact areas. This also effected the holding force.

SUMMARY OF THE INVENTION

In a disclosed embodiment of this invention, a portion of the pump unit of a scroll compressor is formed to have a generally cylindrical outer surface of a diameter slightly larger than the inner diameter of the cylinder which is to receive the pump unit. This pump unit may then be interference-fit into the cylinder. Since the cylindrical outer diameter portion is generally continuous, the interference-fit holding force is at a maximum. Also, the amount of interference causes the outer cylinder material to yield. Therefore, the holding force will not be diminished until the internal pressure is high enough to cause the outer cylinder material to yield.

Similarly, the lower bearing is formed with a cylindrical portion which is interference-fit into the cylinder housing.

In a preferred embodiment, the generally cylindrical portion extends at least 315°, more preferably 350°, and most preferably over the entire 360° about the central axis of the compressor. These ranges define the term "generally" as used in this application and its claims.

Applicant has found that with these cylindrical components, there is sufficient holding force, and the relatively simple method of force-fit assembly may be utilized.

In a preferred embodiment of this invention, it is the crankcase which is the portion of the pump unit having the generally cylindrical outer peripheral portion to be force-fit into the cylinder housing.

These and other features of the present invention can be best understood from the following specification and drawings, the following of which is a brief description.

DETAILED DESCRIPTION OF A PREFERRED EMBODIMENT

Figure 1:
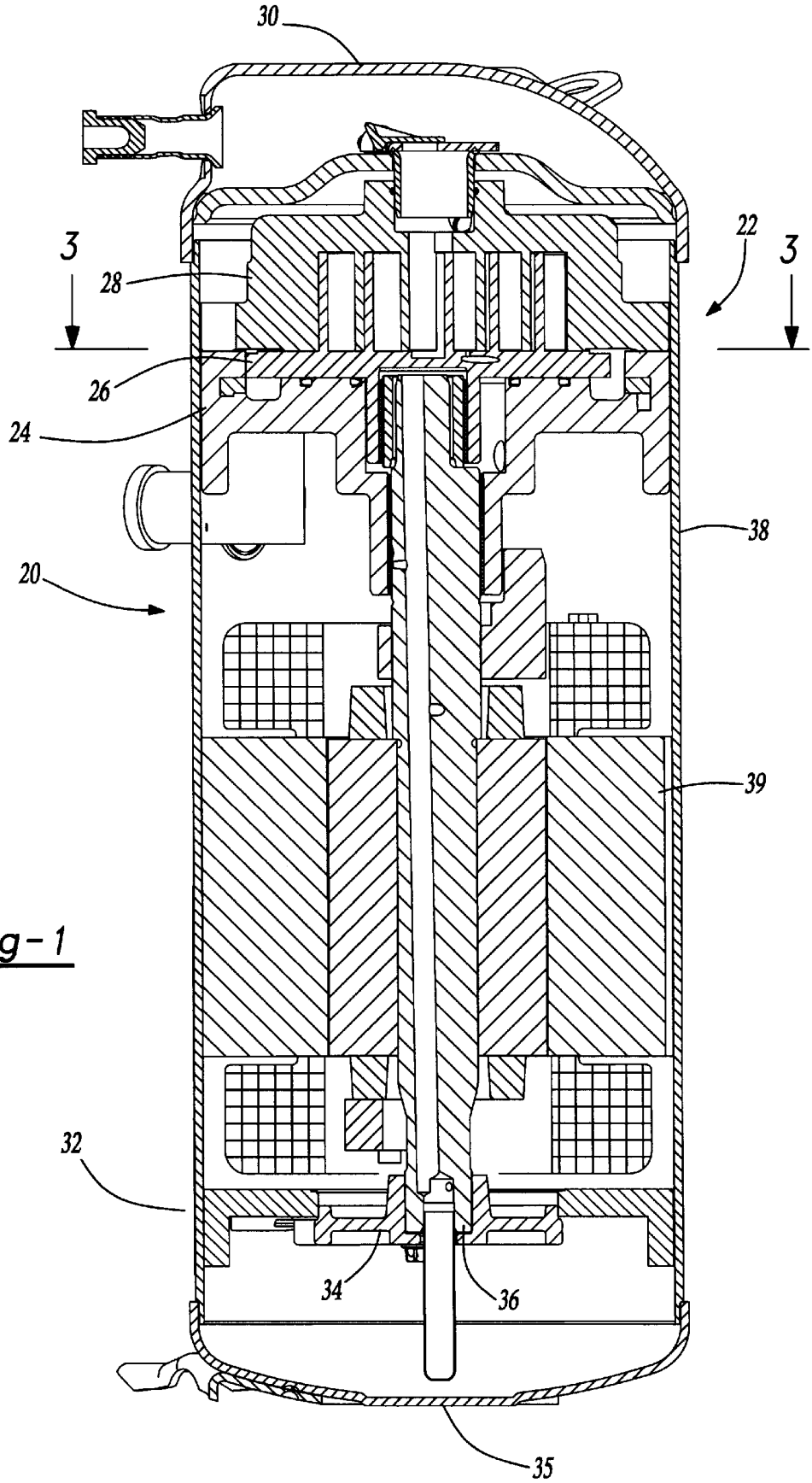
FIG. 1 is a cross-sectional view through an inventive scroll compressor.

FIG. 1 shows a scroll compressor 20 receiving a pump unit 22 including a crankcase 24, an orbiting scroll 26, and a non-orbiting, or fixed scroll 28. Generally, the pump unit 22 is preassembled and then mounted into the compressor as a unit. An endcap 30 encloses the top end of the compressor 20.

A lower bearing mount 32 receives a lower bearing 34. A lower endcap 35 closes the lower end of the compressor. The bearing 34 mounts a shaft 36. Between the endcaps 30 and 35 a generally cylindrical housing 38 receives and encloses all components 24, 26, 28, 30, 32, 34, 36 and a motor 39, as shown in FIG. 1.

The present invention is directed to a method of force-fitting the pump unit 22 and the lower bearing 32 into the housing 38.

Figure 2A:
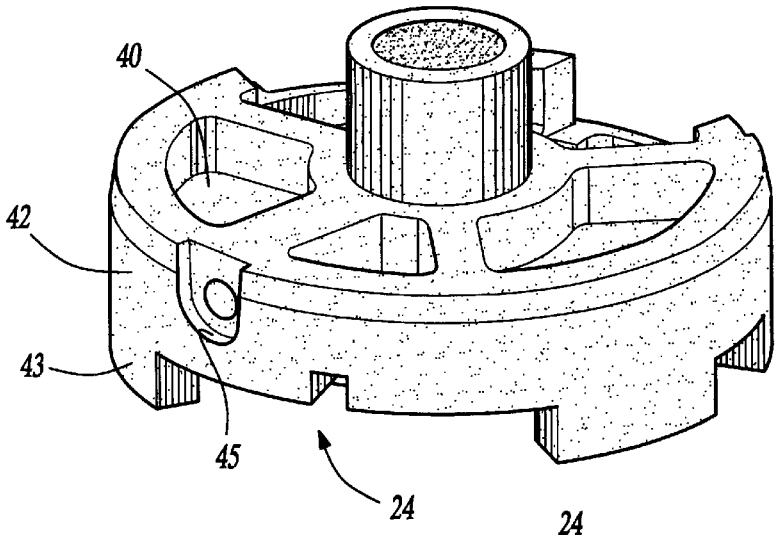
FIG. 2A is a lower perspective view of a crankcase included in the inventive scroll compressor.
Figure 2B:
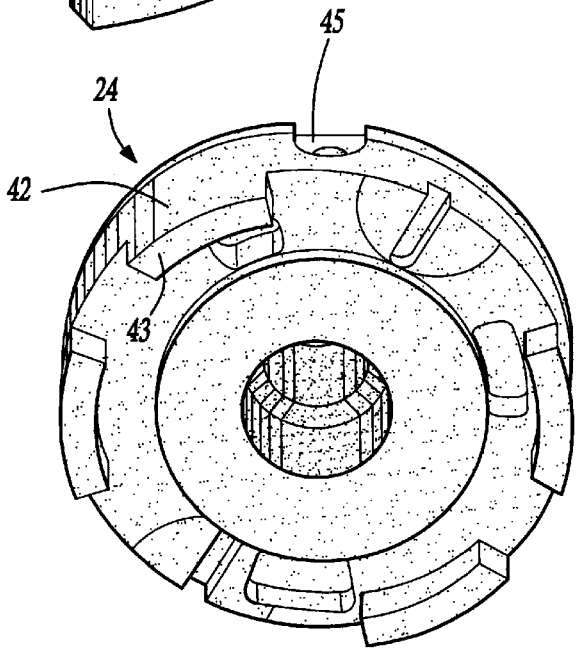
FIG. 2B is an upper perspective view.

As shown in FIG. 2A and B, the crankcase 24 includes lower hollow portions 40 extending away from a generally cylindrical intermediate portion 42 and upper portions 43 extending away from the generally cylindrical portion 42. Portion 42 preferably extends around the entire periphery of the crankcase 24. Preferably, the portion 42 extends for at least 1 inch along the axis of the compressor. As can be seen, it is within the scope of this invention for there to be discontinuities 45 in portion 42.

The structures 40 and 43 are designed to provide various functions within the compressor, and those structures were found in the prior art. It is the inclusion of the intermediate cylindrical portion 42 which is distinct in this invention.

Figure 3:
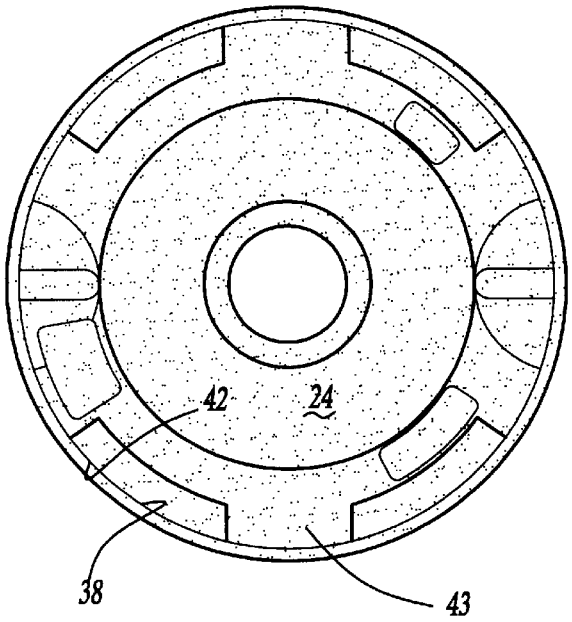
FIG. 3 is a cross-sectional view along line 3—3 of FIG. 1.

As shown in FIG. 3, the crankcase 24 has portion 42 contacting the inner periphery of the housing 38 generally around its entire periphery. In the prior art force-fit crank cases, the contact was only at the spaced portions, such as portions 43.

The present invention increases the holding force by including the cylindrical portion. Preferably, the cylindrical portion extends for 360° about an axis of the compressor. However, the term "generally" is used in this application to make clear that a small discontinuity may be within this invention. That is, portions that extend over 315°, and preferably more than 350° come within the description generally cylindrical.

To achieve the force-fit, the cylindrical portion 42 has an outer diameter which is greater than the inner diameter of the housing 38. In one embodiment, the difference in diameters was 0.020 inches.

Figure 4:
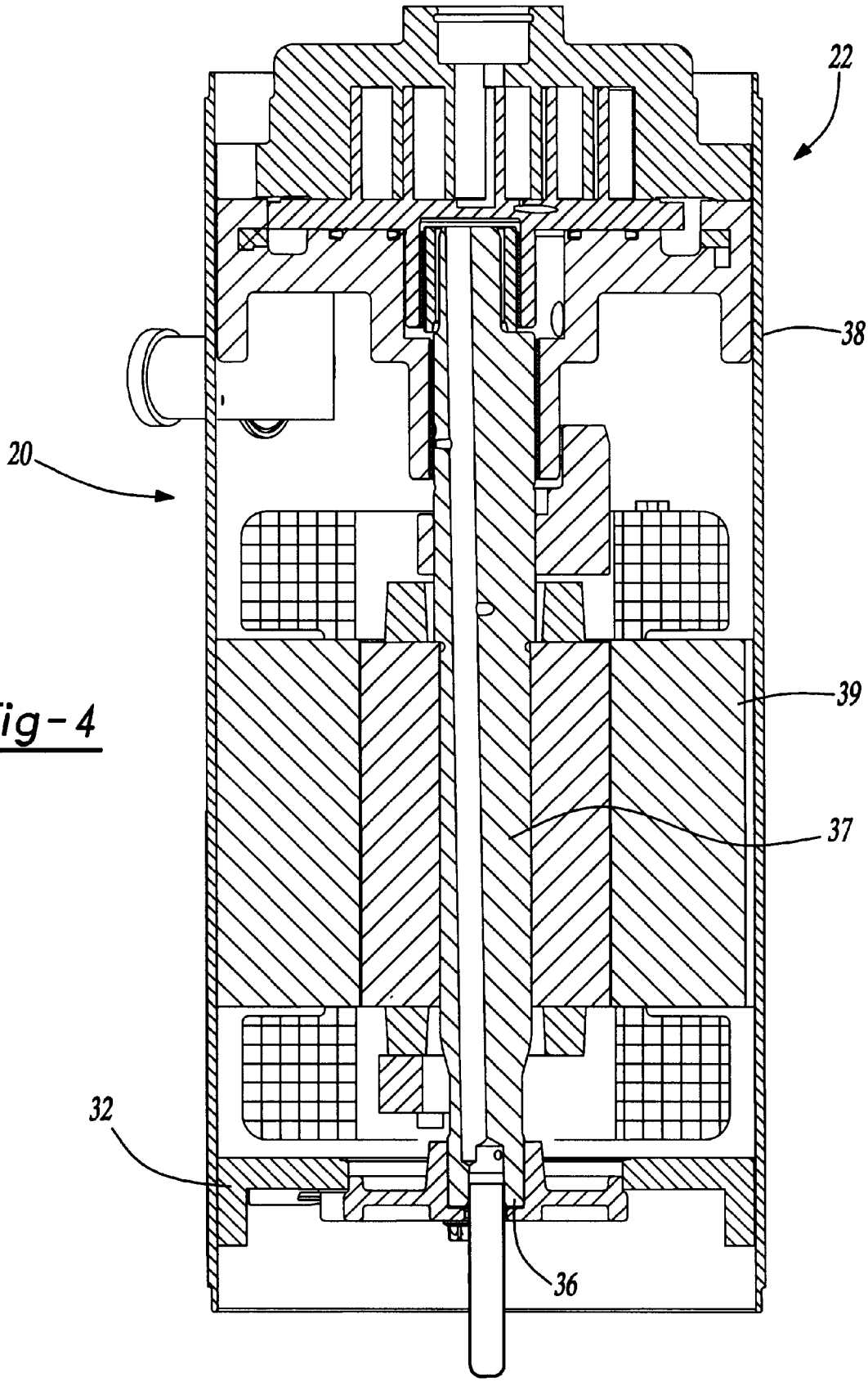
FIG. 4 shows an intermediate step in the assembly of the inventive scroll compressor.

As shown in FIG. 4, the pump unit 22 is initially force-fit into the cylindrical housing 38. The motor stator 39 is also inserted at that time. The bearing support 32 is force-fit into the lower end of the housing 38, and the shaft 36 along with the motor rotor is then inserted into the compressor 20. The end caps may then be assembled.

The bearing support 32 also has a full cylindrical portion, and has an outer diameter which is greater than the inner diameter of the housing 38. By utilizing the full cylindrical portions on the lower bearing support 32 and the crankcase 24, the present invention provides a much greater holding force than was the case in the prior art. This higher holding force leads to higher reliability of these attachment methods over those in prior art.

The inventive attachment method preferably deforms the cylinder beyond its plastic yield point. That is, the interference dimensions are selected such that when the crankcase and the lower bearing support are force fit into the cylindrical housing, the cylindrical housing will deform beyond its plastic yield point. This will further result in a very high holding force, such that the present invention will be able to be utilized practically.

This invention would provide benefits in any interference-fit scroll compressor. The interference-fit could be by force-fitting, or shrink fitting.

A preferred embodiment of this invention has been disclosed; however, a worker of ordinary skill in this art would recognize that certain modifications come within the scope of this invention. For that reason, the following claims should be studied to determine the true scope and content of this invention.

What is claimed is:

1. A method of assembling a scroll compressor comprising the steps of:

providing a pump unit including a crankcase, a first scroll, and a second scroll between said crankcase and said first scroll;

providing a housing having a cylindrical inner surface, and forming a generally cylindrical surface on one of said crankcase and said first scroll, said cylindrical surface having a first outer diameter, and said cylindrical housing having a second inner diameter, and said first outer diameter being greater than said second inner diameter; and then interference-fitting said pump unit into said housing to secure said pump unit within said cylindrical housing, said interference fit causing said housing to deform beyond its plastic yield point.

2. A method as recited in claim 1, wherein said cylindrical surface is formed on said crankcase.

3. A method of assembling a scroll compressor comprising the steps of:

providing a pump unit including a crankcase, a first scroll, and a second scroll between said crankcase and said first scroll;

providing a housing having a cylindrical inner surface, and forming a generally cylindrical surface on one of said crankcase and said first scroll, said cylindrical surface having a first outer diameter, and said cylindrical housing having a second inner diameter, and said first outer diameter being greater than said second inner diameter; and then interference-fitting said pump unit into said housing to secure said pump unit within said cylindrical housing, wherein said cylindrical surface is formed on said crankcase, and a lower bearing support is also provided with a cylindrical outer surface, and said lower bearing support is force fit into said cylindrical housing.

4. A method as recited in claim 3, wherein said interference fit causes said housing to deform beyond its plastic yield point.

5. A method of assembling a scroll compressor comprising the steps of:

providing a pump unit including a crankcase, a first scroll, and a second scroll between said crankcase and said first scroll;

providing a motor and a shaft, said shaft being connected to drive said second scroll relative to said first scroll;

providing a lower bearing support for said shaft at a location below said motor, said lower bearing support having a generally cylindrical outer surface having an outer diameter, and providing a housing having a cylindrical inner surface, said cylindrical inner surface having an inner diameter which is less than said outer diameter of said generally cylindrical surface of said lower bearing support; and then interference-fitting said lower bearing support into said housing to secure said lower bearing support within said housing.

6. A scroll compressor comprising:

a first scroll member and a second scroll member, each of said first and second scroll members being formed with a base and a generally spiral wrap extending from said base, said spiral wraps of said first and second scroll members interfitting to define compression chambers, and said second scroll member being driven to orbit relative to said first scroll member;

a crankcase for supporting said second scroll member, said crankcase having a generally cylindrical outer surface portion of a first diameter;

a cylindrical housing receiving said crankcase and having an inner diameter of a second diameter, said first diameter being greater than said second diameter, and said crank case being interference-fit into said cylindrical housing, a shaft driven by a motor serves to orbit said second scroll member, said shaft being supported at an end remote from said second scroll member in a bearing, and a bearing support being force-fit into said cylindrical housing for supporting said bearing, said bearing support having a generally cylindrical outer surface portion.

7. A scroll compressor as recited in claim 6, wherein said generally cylindrical portion extends for at least 350° about an axis of said scroll compressor.

8. A scroll compressor comprising:

a first scroll member and a second scroll member, each of said first and second scroll members being formed with a base and a generally spiral wrap extending from said base, said spiral wraps of said first and second scroll members interfitting to define compression chambers, and said second scroll member being driven to orbit relative to said first scroll member;

a crankcase for supporting said second scroll member, said crankcase having a generally cylindrical outer surface portion of a first diameter;

a cylindrical housing receiving said crankcase and having an inner diameter of a second diameter, said first diameter being greater than said second diameter, and said crank case being interference-fit into said cylindrical housing, wherein said crankcase has non-continuous portions extending axially from said generally cylindrical portion in both axial directions.

9. A scroll compressor as recited in claim 8, wherein said generally cylindrical portion extends for 360° about an axis of said scroll compressor.

10. A scroll compressor comprising:

a first scroll member and a second scroll member, each of said first and second scroll members being formed with a base and a generally spiral wrap extending from said base, said spiral wraps of said first and second scroll members interfitting to define compression chambers, and said second scroll member being driven to orbit relative to said first scroll member;

a crankcase for supporting said second scroll member, said crankcase having a generally cylindrical outer surface portion of a first diameter;

a cylindrical housing receiving said crankcase and having an inner diameter of a second diameter, said first diameter being greater than said second diameter, and said crank case being interference-fit into said cylindrical housing, wherein said cylindrical housing is taken beyond its plastic yield point by said interference fit.

11. A scroll compressor as recited in claim 6, wherein a shaft is driven by a motor, and serves to orbit said second scroll member, said shaft being supported at an end remote from said second scroll member in a bearing, and a bearing support being force-fit into said cylindrical housing for supporting said bearing, said bearing support having a generally cylindrical outer surface portion.

12. A scroll compressor comprising:

a first scroll member and a second scroll member, each of said first and second scroll members being formed with a base and a generally spiral wrap extending from said base, said spiral wraps of said first and second scroll members interfitting to define compression chambers, and said second scroll member being driven to orbit relative to said first scroll member by a motor driven shaft;

a cylindrical housing and a motor received within said cylindrical housing, said cylindrical housing having an inner diameter of a second diameter, a lower bearing support being positioned on an opposed side of said motor from said first and second scroll members, and supporting an end of said shaft, said lower bearing support having a generally cylindrical portion of a first outer diameter which is greater than said second outer diameter, and said lower bearing support being interference-fit into said cylindrical housing.

13. A scroll compressor as recited in claim 12, wherein said generally cylindrical portion extends for at least 350° about an axis of said scroll compressor.

14. A scroll compressor as recited in claim 13, wherein said generally cylindrical portion extends for 360° about an axis of said scroll compressor.

15. A scroll compressor as recited in claim 12, wherein said cylindrical housing is taken beyond its plastic yield point by said interference fit.

16. A method of assembling a scroll compressor comprising the steps of:

providing a pump unit including a crankcase, a first scroll, and a second scroll between said crankcase and said first scroll;

providing a housing having a cylindrical inner surface, and said cylindrical inner surface having an inner diameter which is less than an outer diameter of one of said crankcase and said first scroll; and then interference fitting said pump unit into said housing to secure said pump unit within said cylindrical housing, said interference fit being designed such that the interference fitting of said pump unit into said housing causes said housing to deform beyond its plastic yield point.

17. A method as recited in claim 16, wherein a lower bearing supports an end of a shaft which drives said orbiting scroll, said lower bearing support also being interference fit into said cylindrical housing, and said interference fit of said lower bearing support also causing said housing to deform beyond its plastic yield point.

* * * * *